US005346149A

United States Patent [19]

Cobb

[11] Patent Number: 5,346,149

[45] Date of Patent: Sep. 13, 1994

[54] ADJUSTABLE PIPE WRAP MACHINE

[76] Inventor: Robert E. Cobb, 9118 E. Latimer Ct., Tulsa, Okla. 74115

[21] Appl. No.: 108,765

[22] Filed: Aug. 16, 1993

Related U.S. Application Data

[63] Continuation of Ser. No. 608,353, Nov. 2, 1990, abandoned.

[51] Int. Cl.[5] ..... B21F 17/00

[52] U.S. Cl. ..... 242/7.22; 226/180; 57/10

[58] Field of Search ..... 57/3, 10; 242/7.19, 242/7.20, 7.21, 7.22, 7.23; 226/180

[56] References Cited

U.S. PATENT DOCUMENTS

| | | | |
|---|---|---|---|
| 2,770,284 | 11/1956 | Myrick | 242/7.22 |
| 2,923,486 | 2/1960 | Betzel | 57/10 |
| 3,074,605 | 1/1963 | Shaw | 242/7.22 |
| 3,322,291 | 5/1967 | Smith | 226/180 |
| 3,479,808 | 11/1969 | Frill | 57/10 |
| 3,789,594 | 2/1974 | Rees | 242/7.22 |
| 4,028,164 | 6/1977 | Montagut | 242/7.22 |
| 4,179,804 | 12/1979 | Maytham | 226/180 |
| 5,022,595 | 6/1991 | Goekler | 242/7.22 |

*Primary Examiner*—Katherine Matecki

*Attorney, Agent, or Firm*—Catalano, Zingerman & McKay

[57] ABSTRACT

A pipe wrap machine capable of dispensing one or more continuous strips of pipe wrapping material in a constant spiral path around a pipe includes mechanisms for simultaneously setting and calibrating the pitch of the spiral path of the machine. The shafts of three longitudinally aligned pairs of wheels are connected so that each pair of wheels can be simultaneously rotated to a selected angular alignment in relation to the pipe circumference. Each connecting rod is provided with an indicator and scale, so that each pair of wheels may be easily rotated to a precalibrated position to provide the desired amount of pitch. Each of the wheel shafts extends through a collar mounted on the machine frame. A set screw through each collar permits locking of its shaft at selected lengths of extension through the collar. Depending upon the diameter of the pipe to be wrapped, the set screws are loosened, the shafts extended to conform to the length of a precut spacing rod selected according to intended pipe diameter, and the set screws retightened to lock each shaft at precisely the right length for the pipe to be wrapped.

5 Claims, 4 Drawing Sheets

ADJUSTABLE PIPE WRAP MACHINE

This is a continuation of copending application Ser. No. 07/608,353 filed on Nov. 2, 1990 now abandoned.

BACKGROUND OF THE INVENTION

This invention relates generally to machines for wrapping lengths of pipe and more particularly concerns a pipe wrapping machine quickly adaptable to wrap pipes of different diameter and at various widths of overlap.

Pipe wrap machines typically consist of a frame which may be positioned around the circumference of a pipe and clamped in position. Wheels mounted on the interior portion of the frame abut the pipe so that the wheels and the frame can be rotated about the pipe. Wrapping tape is applied during rotation of the machine from one or more dispensers mounted on the frame.

Depending upon the particular application requirements, the diameter of the pipe and the amount of tape wrap overlap varies from job to job or even on the same job. As a result, several pipe wrap machines may be required to handle pipe bends, pipe diameter changes and tape overlap widths.

In order to minimize these problems, many presently known pipe wrap machines include features permitting adaptation for diameter and overlap variations.

With respect to the width of the overlap, the wheels are typically mounted on shafts that extend radially from the pipe to the frame. Depending on the width of overlap desired, the angle of the wheels in relation to the pipe circumference is changed by rotating the shafts. Unfortunately, the machine requires at least six such shaft and wheel arrangements which are each separately aligned. It generally takes hours to align all of the wheels at the same angle so that the machine rotates smoothly about the pipe. Even then, relatively small inconsistencies in the wheel angles result in a binding in the rotation of the machine that makes operation difficult.

Adjustment is usually made for the diameter of the pipe by resetting the extension of the shafts connecting the wheels to the frame. This typically requires the removal of bolted plates used to mount the shaft to the frame, adjustment of the plate spacing to the desired length of extension and rebolting the plate. This is a tedious and time consuming task which is further compounded by the difficulty in obtaining exactly the same extension with respect to each shaft. Repeated readjustment of some of the settings to achieve extension equality is frequently required. Differences in extension length of any shaft results in a rocking or wobble of the machine during its rotation around the pipe. This in turn results in an inconsistent and uneven application of wrap to the pipe.

It is, therefore, among the objects of this invention to provide a pipe wrapping machine which facilitates rapid adaptation to variations in pipe diameter and to wrap overlap requirements. It is also among the objects of this invention to provide a pipe wrap machine that is lightweight, easy to handle, consistent in operation, and mechanically simple.

SUMMARY OF THE INVENTION

In accordance with the invention, a pipe wrap machine capable of dispensing one or more continuous strips of pipe wrapping material in a constant spiral path around a pipe includes mechanisms for simultaneously setting and calibrating the pitch of the spiral path of the machine. The shafts of longitudinally aligned pairs of wheels are interconnected so that each pair of wheels can be simultaneously rotated to a selected angular alignment. Each connecting rod is provided with an indicator and scale, so that each pair of wheels may be easily rotated to a precalibrated position to provide the desired amount of pitch. Each of the wheel shafts extends through a collar mounted on the machine frame. A set screw through each collar permits locking of its shaft at selected lengths of extension through the collar. Depending upon the diameter of the pipe to be wrapped, the set screws are loosened, the shafts extended to conform to the length of a precut spacing rod selected according to intended pipe diameter, and the set screws retightened to lock each shaft at precisely the right length for the pipe to be wrapped.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
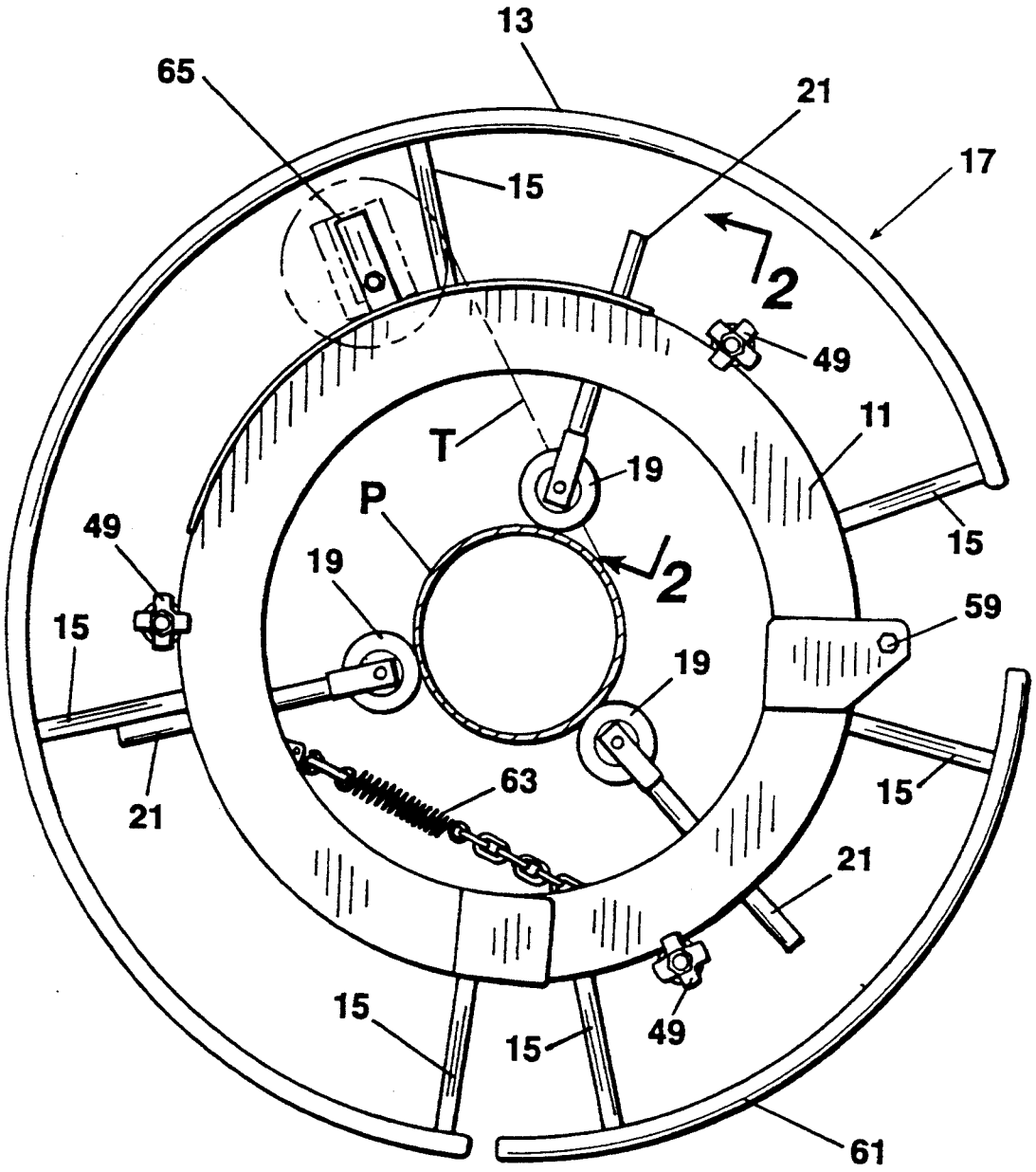
FIG. 1 is a side elevational view of a preferred embodiment of the pipe wrap machine mounted on a pipe.

Referring to the Figures generally, the illustrated embodiment of the pipe wrap machine is used to wrap a pipe P with tape T shown in phantom in FIG. 1. In this embodiment, the machine includes a pair of circular bands 11 in spaced apart face-to-face relationship. Concentrically disposed about the bands are a pair of rotating handles 13 connected to the bands 11 by spacers 15. The bands 11, handles 13 and spacers 15 together form the frame 17 of the pipe wrap machine.

In order to mount the frame 17 for rotation about the pipe P, three pairs of wheels 19 are connected to the frame 17. Each of the wheels 19 is mounted in a caster-like arrangement to a shaft 21 with each of the shafts 21 extending radially inwardly toward the center of the frame 17. Mounting brackets 23 are welded to the interior face of the bands 11 at a fixed circumferential spacing of approximately 120°. Sleeves 25 are welded to the brackets with the sleeves 25 aligned to receive the shafts 21 in their appropriate radial disposition. As shown, each shaft 21 is mounted through a pair of spaced apart sleeves 25 and a collar 27 between the sleeves 25 is keyed 29 to its shaft 21. An arm 31 is welded to each collar 27 so that rotation of the arm 31 results in rotation of the keyed collar 27 and shaft 21 and therefore the wheel 19.

Figure 2:
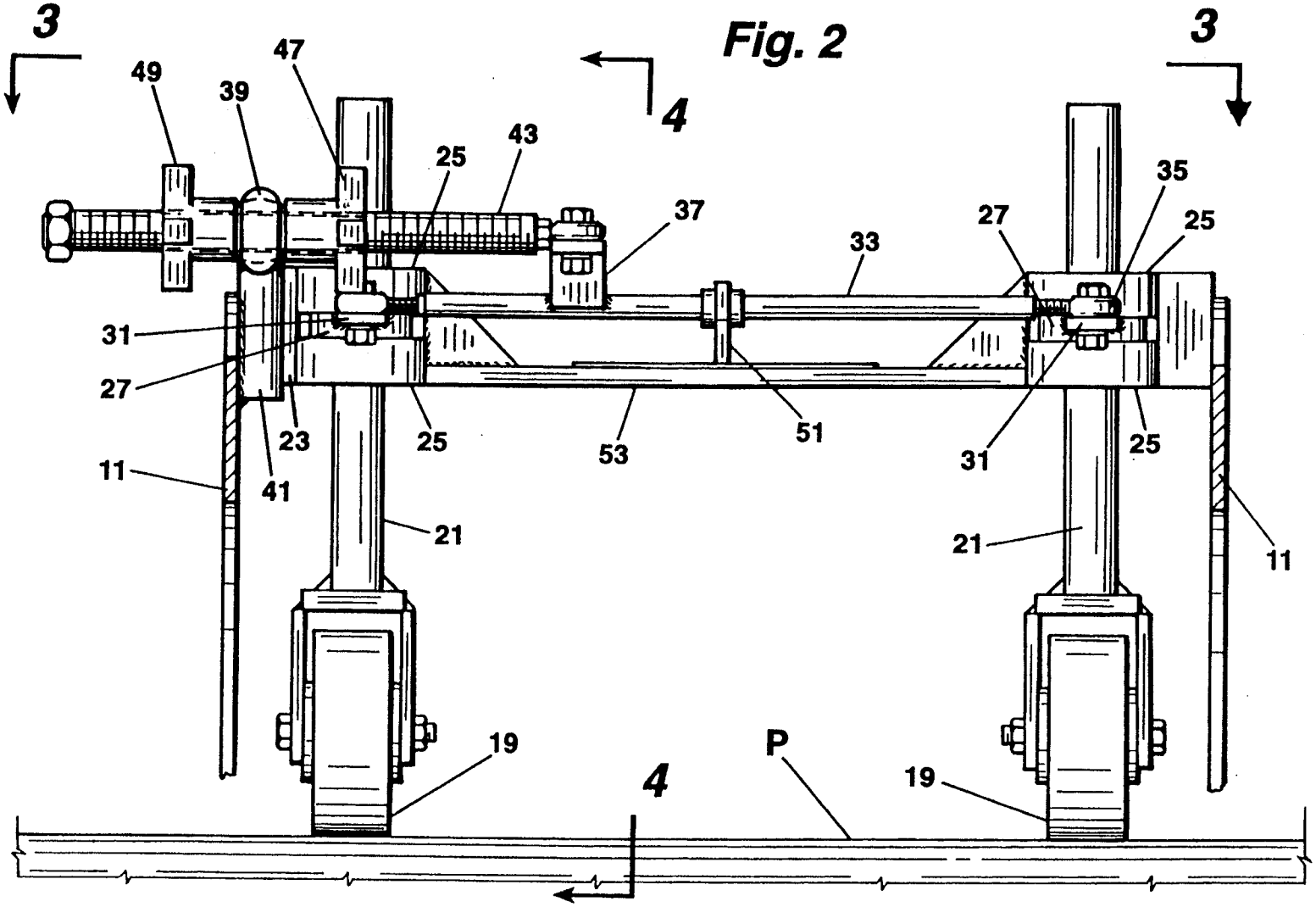
FIG. 2 is a cross-sectional view taken along the line 2—2 of FIG. 1.
Figure 3:
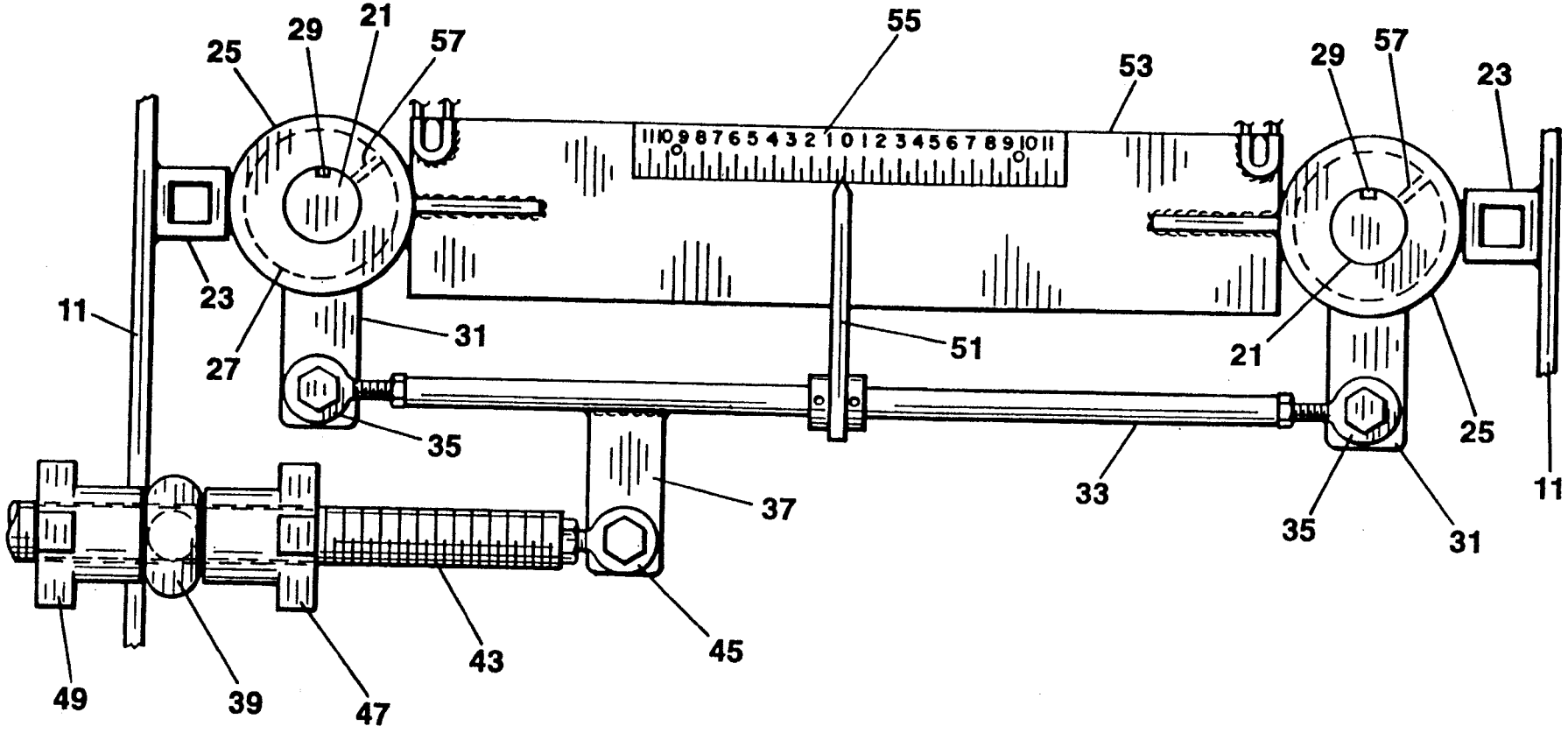
FIG. 3 is a top view taken along the line 3—3 of FIG. 2.
Figure 4:
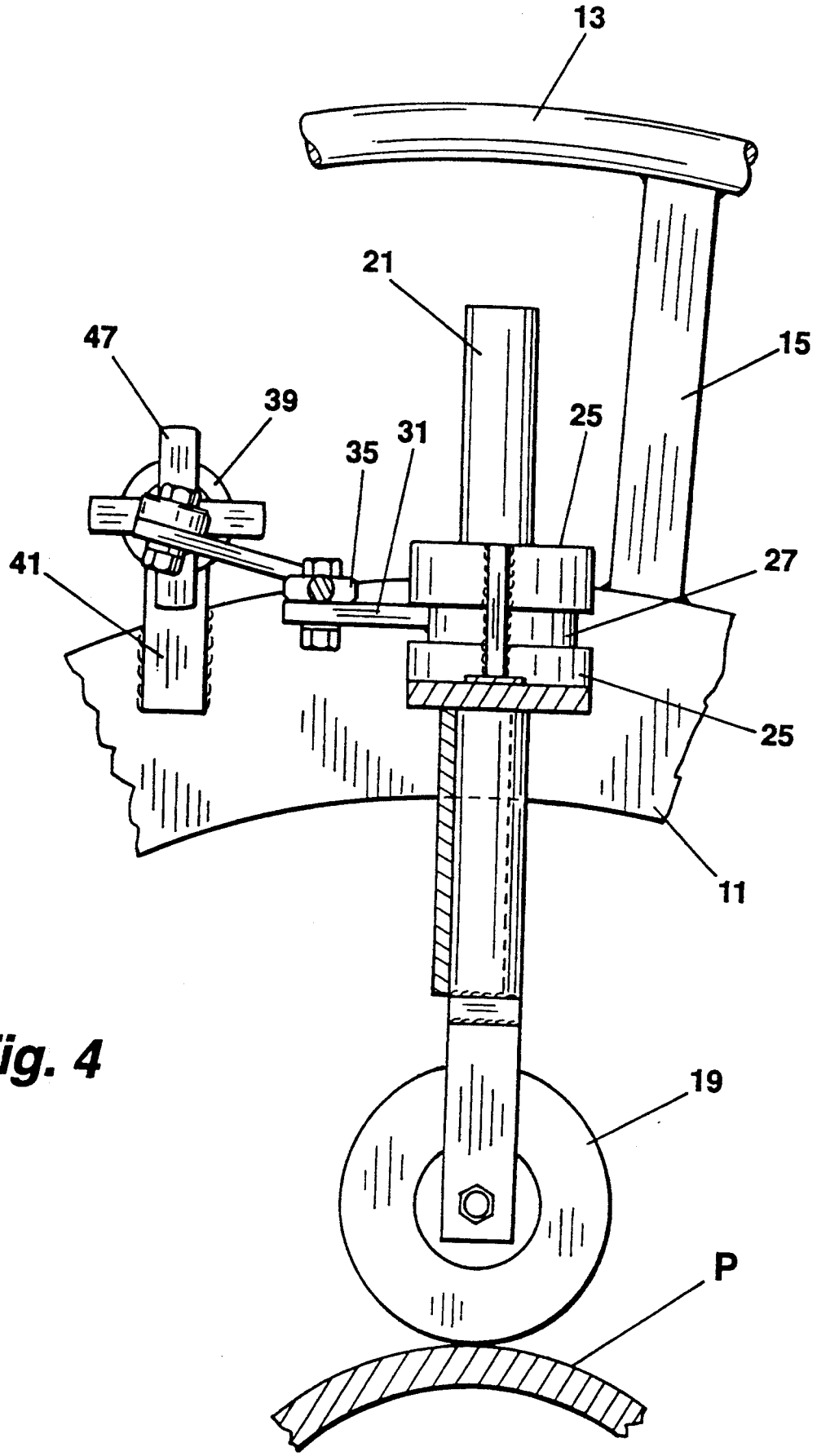
FIG. 4 is a cross-sectional view taken along the line 4—4 of FIG. 2.

As can best be seen in FIG. 2, the arms 31 associated with longitudinally aligned wheels 19 are joined for rotation together by a connecting rod 33 which is journalled at its ends 35 to the arms 31. A push-pull bracket 37 is also welded to the connecting rod so that as the bracket 37 is pushed or pulled, the movement of the rod 33 simultaneously rotates the arms 31 associated with longitudinally aligned wheels 19 to rotate those wheels 19 simultaneously in relation to the circumference of the pipe P. A rod eye bearing 39 mounted on a bracket 41 is fixed to the frame 17 so that a threaded rod 43 can be journalled at one end 45 to the push-pull bracket 37 and extend through the rod eye bearing 39. Interior and exterior lock handles 47 and 49, respectively, threadedly mounted on the threaded rod 43, can be alternately loosened and tightened in relation to the rod eye bearing 39 to vary the position of the push-pull bracket 37 and, therefore, the angle of the associated wheels 19. Also mounted on the connecting rod 33 is an indicator 51. A support bracket 53 is welded in fixed position between the bands 11, perhaps by attachment to the sleeves 25 as illustrated in FIGS. 2 and 3. A scale 55 is mounted on the bracket 53 which is calibrated for various angular positions of the wheels 19 in relation to the circumference of the pipe P. The scale 55 is located in relation to the indicator 51 so that, as the wheels 19 are rotated, their angular position can be determined by the location of the indicator 51 on the scale 55. As shown, the scale 55 has a zero center point and the angle of the wheels 19 can therefore be determined with respect to negative or positive pitch of the machine.

Each of the collars 27 is provided with a set screw 57. Thus, with the set screw 57 in the loosened condition, the shaft 21 can be more fully inserted or withdrawn within the sleeves 25 to permit adjustment of the radial position of the wheels 19 in relation to the center of the pipe wrap machine. Thus, the extension of the shafts 21 can be varied to adapt the machine to pipes of various diameter.

As can best be seen in FIG. 1, the bands 11 are hinged at 59 and the handles 13 have a detached segment 61 which permit the machine to be opened for mounting on the pipe. A spring tension latching mechanism 63 is provided to secure the hinged frame 17 around the pipe P. Also illustrated in FIG. 1 is a single tape dispenser 65. The tape dispensers can be mounted on either side of the frame 17 or within the frame 17 at any point along the circumference. Thus, it is possible to apply several layers of tape in a single wrapping operation.

In operation, the diameter of the pipe P to be wrapped is first determined. The set screws 57 in each of the collars 27 are loosened. A spacer bar (not shown) of length predetermined to adapt the tape wrapping machine to a specific diameter of pipe P is used to set the extension length of each of the shafts 21 through their respective sleeves 25. Each set screw 57 is then tightened to lock the shaft 21 in the appropriate position so that the wheels 19 will be concentrically disposed about the pipe P. The desired pitch of the wrap is then established by adjusting the interior and exterior lock handles 47 and 49 until the indicator 51 aligns with the setting of the scale 55 which will provide the predetermined amount of pitch. This is done for each pair of longitudinally aligned wheels 19. With the shaft lengths and wheel pitches so determined, the hinged portion of the machine is opened and the machine is mounted on the pipe P. The hinged portion is then closed and the latching mechanism 63 tightened to secure the machine in its position on the pipe P. With one or more rolls of tape T located on their appropriate dispensers 65 and the tape adhered to the pipe P, the entire machine is then rotated by rotation of the handles 13. The machine will spiral about the pipe P in accordance with the pitch established on the calibrated scale 55.

If the pipe diameter should change or if a bend in the pipe should occur, the above adjustment process can be repeated so that the same machine can be used to continue the wrapping of the pipe P.

It has been found that by use of the presently described device, the same machine can be adapted for variations in pipe and wrap dimensions in a small fraction of the time heretofore required to adjust such machines.

The invention has been described in relation to a welded steel construction, but lightweight aluminum construction or other suitable materials could be employed. It is further contemplated that the device may be motor driven rather than manually rotated about the pipe.

Thus it is apparent that there has been provided, in accordance with the invention, a pipe wrapping machine that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit of the appended claims.

What is claimed is:

1. A pipe wrapping machine comprising:

means for dispensing a continuous strip of pipe wrapping material;

means for supporting said dispensing means radially outwardly of the longitudinal axis of a pipe, said supporting means having an axis of rotation coincident with said longitudinal axis of said pipe;

means having three pairs of longitudinally aligned casters for guiding said supporting means in a constant spiral path around said pipe, said pairs of casters having a fixed circumferential spacing relative to said pipe, each of said casters being mounted on and rotatable with a shaft extending along a radius originating from said longitudinal axis of said pipe;

means adjustably connecting said guiding means to said supporting means for selectively varying the radial disposition of said casters to conform to the outer diameter of said pipe and to cause said longitudinal axis of said pipe to coincide with said axis of rotation of said supporting means; and means connecting both casters of each said pair of longitudinally aligned casters for simultaneous rotation of both casters of each said pair with their respective shafts about their respective said radii without varying said radial disposition of said casters to provide a preselected overlap of dispensed wrapping material around said pipe.

2. A pipe wrapping machine according to claim 1, said simultaneous rotation connecting means comprising three adjusting means, one for each said pair of longitudinally aligned casters, each said adjusting means comprising:

a pair of arms, one keyed to each said shaft of a pair of casters for rotation with its respective shaft;

means connecting said pair of arms for simultaneous rotation of said arms and said shafts;

means for scaling predetermined angular positions of said casters in relation to said spiral pitch; and means movable with said connecting means in relation to said scaling means for indicating the pitch of said spiral.

3. A pipe wrapping machine according to claim 2 further comprising means for locking said connecting means to said supporting means with said casters in any one of said predetermined angular positions.

4. A pipe wrapping machine according to claim 1, said simultaneous rotation connecting means comprising three adjusting means, one for each said pair of longitudinally aligned casters, each said adjusting means comprising:

a pair of arms, one keyed to each said shaft of a pair of casters for rotation with its respective shaft; and means connecting said pair of arms for simultaneous rotation of said arms and said shafts.

5. A pipe wrapping machine comprising:

means for dispensing a continuous strip of pipe wrapping material;

means for supporting said dispensing means radially outwardly of the longitudinal axis of a pipe, said supporting means having an axis of rotation coincident with said longitudinal axis of said pipe;

means having three pairs of longitudinally aligned radially disposed casters for guiding said supporting means in a constant spiral path around said pipe, said pairs of casters having a fixed circumferential spacing relative to said pipe;

means adjustably connecting said guiding means to said supporting means for selectively varying the radial disposition of said casters to conform to the outer diameter of said pipe and to cause said longitudinal axis of said pipe to coincide with said axis of rotation of said supporting means; and means for simultaneously setting the pitch of both casters of each said pair of longitudinally aligned casters about their respective radii without varying said radial disposition of said casters to provide a preselected overlap of dispensed wrapping material around said pipe, said simultaneous pitch setting means comprising three connecting rods, each rod being connected to both casters of one of said pairs of longitudinally aligned casters.

* * * * *